US006183266B1

(12) United States Patent
Turner

(10) Patent No.: US 6,183,266 B1
(45) Date of Patent: Feb. 6, 2001

(54) METHOD AND APPARATUS FOR TRANSFERRING SIGNALS THROUGH A HIGH DENSITY, LOW PROFILE, ARRAY TYPE STACKING CONNECTOR

(75) Inventor: Leonard O. Turner, Vancouver, WA (US)

(73) Assignee: Intle Corporation, Santa Clara, CA (US)

( * ) Notice: Under 35 U.S.C. 154(b), the term of this patent shall be extended for 0 days.

(21) Appl. No.: 09/151,394

(22) Filed: Sep. 10, 1998

(51) Int. Cl.[7] ..... H01R 12/00
(52) U.S. Cl. ..... 439/66; 439/74; 439/101
(58) Field of Search ..... 439/66, 74, 63, 439/578, 608, 101

(56) References Cited

U.S. PATENT DOCUMENTS 4,603,926 * 8/1986 Nesbit et al. ..... 439/63
4,895,522 * 1/1990 Grabbe et al. ..... 439/63
5,397,241 * 3/1995 Cox et al. ..... 439/79
5,718,592 * 2/1998 Hosler, Sr. et al. ..... 439/63
5,743,765 * 4/1998 Andrews et al. ..... 439/608
5,791,911 * 8/1998 Fasano et al. ..... 439/63
5,807,116 * 9/1998 Kitatani et al. ..... 439/63
5,938,450 * 8/1999 Nagafuji ..... 439/63
6,027,345 * 2/2000 McHugh et al. ..... 439/66

OTHER PUBLICATIONS

"Sudden Solution Guide," Full Line Catalog F–197, Apr. 1997, pp. 6, 50–51.

* cited by examiner

*Primary Examiner*—T. C. Patel
(74) *Attorney, Agent, or Firm*—Jeffrey S. Draeger

(57) ABSTRACT

An improved method and apparatus for transferring signals through a stacking connector. A disclosed apparatus includes a first engaging contact member mounted on a first circuit board and a second engaging contact member which removably engages the first engaging contact member mounted on a second circuit board. The first engaging contact member is electrically coupled to a first signal line on the first circuit board and the second engaging contact member is electrically coupled to a second signal line on the second circuit board. A conductive barrier partially surrounds the second engaging contact member. The barrier has at least one connector connecting the barrier to a bias voltage line.

27 Claims, 6 Drawing Sheets

METHOD AND APPARATUS FOR TRANSFERRING SIGNALS THROUGH A HIGH DENSITY, LOW PROFILE, ARRAY TYPE STACKING CONNECTOR

BACKGROUND OF THE INVENTION

1. Field of the Invention

The present invention pertains to the field of connectors for transmitting signals between circuit boards or other components. More particularly, the present invention pertains to the use of a coaxial connector arrangement for connecting such circuit boards or other components.

2. Description of Related Art

Improving the overall signal transfer characteristics of circuit board connectors can allow higher frequency signals to be transferred through such connectors. As a result, system level signal frequencies may be raised when an improved connector is employed in a system where the connector would otherwise limit the speed of system communication.

Stackable connectors are connectors which allow circuit boards that are substantially parallel to be connected. Using prior art techniques, high-frequency signals that must pass from one circuit board to another arc electrically connected using an ordinary interconnect pin/socket set. These prior art pin/socket sets typically include a pin mounted on a first circuit board and electrically coupled to a first signal line on the first circuit board. A socket mounted on a second circuit board which engages the pin couples the first signal line to a second signal line in the second circuit board.

Adjacent pin/socket sets and any intervening gaps or insulating material define noise immunity and impedance characteristics for such prior art pins. In some cases, these adjacent pin/socket sets may be used as barrier posts (which may be biased to a specific potential) in an attempt to achieve the desired impedance and/or noise immunity. In some cases, despite the use of pin/socket sets as discrete barrier posts, due to unequal spacing and gaps, electrical noise may pass between the barrier posts and induce spurious currents in the signal pin. Thus, while this prior art arrangement provides a degree of noise immunity, the impedance control and noise immunity characteristics may no longer suffice as the frequency of signals passing through such connectors continues to rise.

Additionally, the prior art provides no simple and effective means of controlling the characteristic impedance of the signal pin. Impedance is determined by the spacing between pin/socket sets on the connector, in together with the performance characteristics of the dielectric material occupying the space between the signal-pin/socket set and adjacent pin/socket sets. Adjustment of either of those parameters may be difficult to achieve. Spacing the surrounding pins close enough to achieve the desired impedance control would likely result in fabrication and/or usability difficulties. Changing the dielectric material for the high-speed circuits would likely require change for the entire connector, necessitating reconsideration of mechanical stability and other issues.

Thus, the prior art fails to provide a connector which provides adequate noise immunity and sufficiently controllable impedance characteristics. A connector that does provide noise and/or impedance control could be advantageous in propagating high frequency signals between stacked circuit boards or other parallel surfaces.

SUMMARY

An improved method and apparatus for transferring signals through a stacking connector is disclosed. A disclosed apparatus includes a first engaging contact member mounted on a first circuit board and a second engaging contact member which removably engages the first engaging contact member mounted on a second circuit board. The first engaging contact member is electrically coupled to a first signal line on the first circuit board and the second engaging contact member is electrically coupled to a second signal line on the second circuit board. A conductive barrier partially surrounds the second engaging contact member. The barrier has at least one connector connecting the barrier to a bias voltage line.

BRIEF DESCRIPTION OF THE FIGURES

The present invention is illustrated by way of example and not limitation in the figures of the accompanying drawings.

DETAILED DESCRIPTION

The following description provides an improved method and apparatus for transferring signals through a high density, low profile, array type stacking connector. In the following description, numerous specific details such as particular materials, shapes, and distances are set forth in order to provide a more thorough understanding of the present invention. It will be appreciated, however, by one skilled in the art that the invention may be practiced without such specific details.

Embodiments of the stacking connector described herein utilize a conductive barrier member which partially or substantially surrounds a socket and/or pin in a coaxial arrangement. With such an arrangement, the connector may advantageously be designed to achieve a target impedance for high speed signaling. The target impedance may be achieved by utilizing a predetermined distance or a particular insulating material between the barrier member and the socket and/or pin. Accordingly, different target impedances may be obtained in a straightforward manner by altering one or both of these parameters. In addition, the coaxial arrangement may improve noise immunity characteristics when compared to prior art arrangements. Furthermore, coaxial connectors may be arranged in a region with prior art pin connectors interspersed between them to achieve both high and intermediate levels of impedance control by way of the surrounding conductive barriers.

Figure 1:
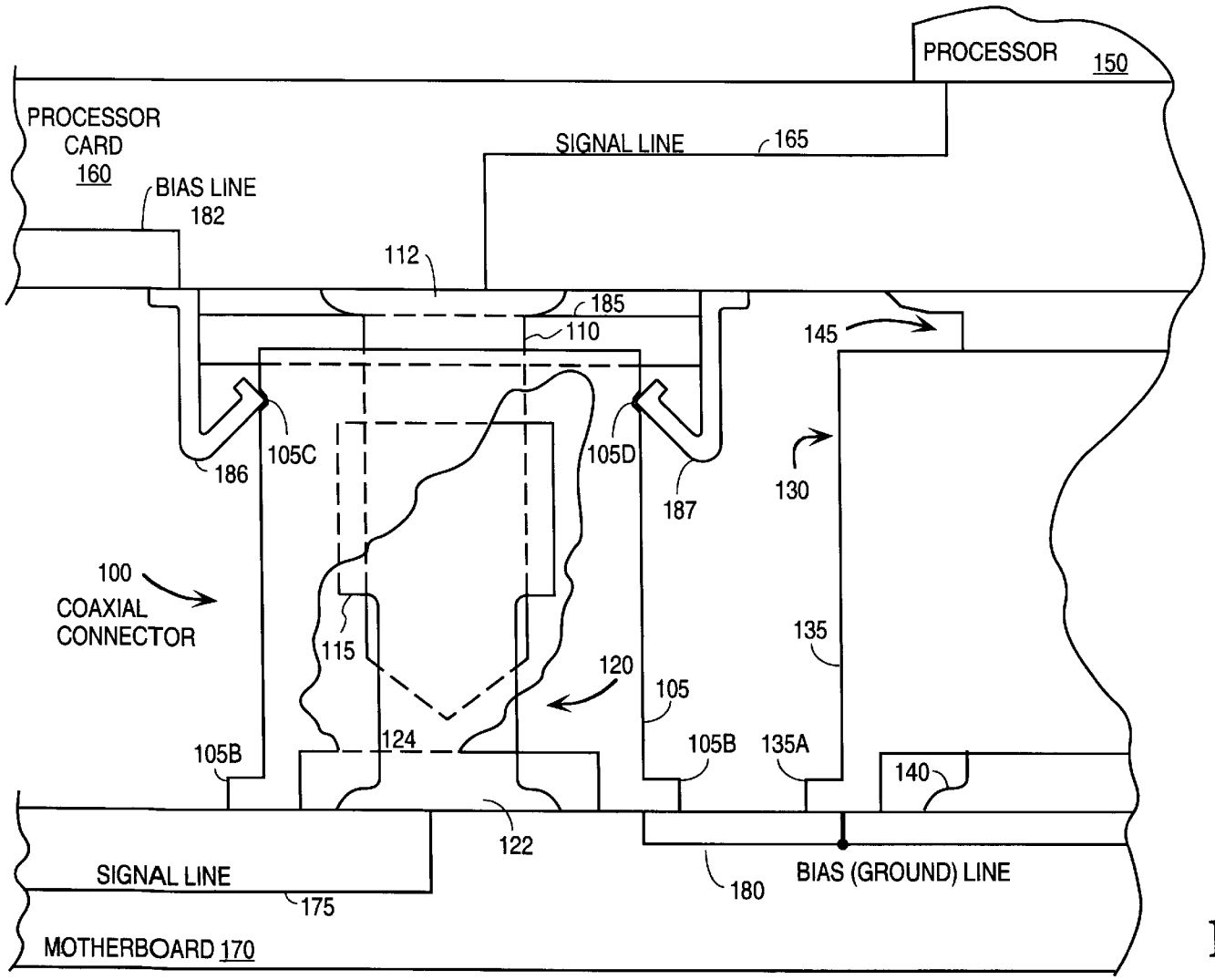
FIG. 1 illustrates one embodiment of a coaxial connector providing electrical contact between a first circuit board and a second circuit board.

FIG. 1 illustrates one embodiment of a coaxial connector 100 which provides electrical contact between a first circuit board, a processor card 160, and a second circuit board, a motherboard 170. In FIG. 1, an enlarged view of the coaxial connector 100 is shown to highlight the details of the connector. The scale of other components may not match that of the coaxial connector 100, with connector 100 typically being much smaller than illustrated when compared to the circuit boards and other components. The physical mounting and electrical connection of various components to the circuit boards are not detailed as a variety of methods available in the art may be used.

The coaxial connector 100 of FIG. 1 includes a conductive barrier 105 and engaging contact members housed inside the barrier 105. In this embodiment, the engaging contact members are an elongated pin 110 and a socket portion 120. Due to the fact that the elongated pin 110 and socket portion 120 are housed within the barrier 105, electromagnetic fields from signals passing through these engaging contact members are substantially confined to within the barrier 105. Additionally, the barrier 105 substantially shields signals passing through the engaging contact members from electromagnetic fields from without the barrier 105.

Since the barrier 105 has openings on each end sufficient to pass signal wires, the barrier 105 can not completely shield the pin 110 and socket portion 120 from all electromagnetic fields. The openings on the top and bottom of the barrier 105, however, need only be sufficiently large to pass a wire, pin, contact, or other conductive engaging structures which pass signals through the connector. The barrier 105 itself may be cylindrical in shape, or may be shaped in a rectangular or any other convenient shape which allows an elongated hollow cavity to house engaging contact members. Typically better impedance control and noise immunity results when the barrier 105 is solid and substantially surrounds the conductive engaging structures therein. However, partial shielding using a partially closed barrier may also be used.

In the embodiment of FIG. 1, a signal from a component such as a processor 150 is transmitted along a signal line 165 to a contact portion 112 of the pin 110. Again the connections to and within the circuit boards are simplifications because a variety of known techniques may be used. When, as illustrated, the pin 110 and socket portion 120 are mated, the signal passes from the contact 112 through the pin 110 to a socket body 115, down through a socket support member 124, through a contact 122, and to a signal line 175 in the motherboard 170.

The barrier 105 is electrically coupled in at least one location to at least one bias voltage line. In the illustrated embodiment, the barrier 105 includes contacts 105*a* and 105*b* which may physically mount the barrier 105 on the motherboard 170 as well as providing electrical contact to a bias line 180. Typically, the bias line 180 is connected to ground; however, other bias voltages may be used.

Additionally, the barrier 105 may be electrically connected to a bias line 182 in the processor card 160. Such a connection may be in addition to or a substitute for the connection to the bias line 180 in the motherboard. In the illustrated embodiment, a support member 185 is connected to the bias line 182 and includes spring contacts 186 and 187 which removably mate with respectively notches 105*c* and 105*d* in the barrier 105. The support member 185 may be formed by a metallic strip sufficient to support the spring contacts 186 and 187 (see, e.g., FIGS. 4–5). Alternatively, the support member 185 may be cylindrical, approximately cylindrical, or otherwise shaped to provide additional shielding.

A second coaxial connector 130 is also shown in FIG. 1 to illustrate the fact that a number of such coaxial connectors would typically be used to electrically couple a number of signals on a first circuit board to signal lines on a second circuit board. The second coaxial connector 130 does not provide a cutaway view of its barrier 135, therefore, only the bottom of the socket portion 140 and the top of the pin portion 145 can be seen from this perspective. The barrier 135 also includes a contact 135*a* which connects to the same bias line 180 as the barrier 105. Although such common connections are often convenient and effective to limit crosstalk between signals, other more elaborate biasing techniques may be used to bias the barriers if further improvement in signal isolation is desired.

Figure 2:
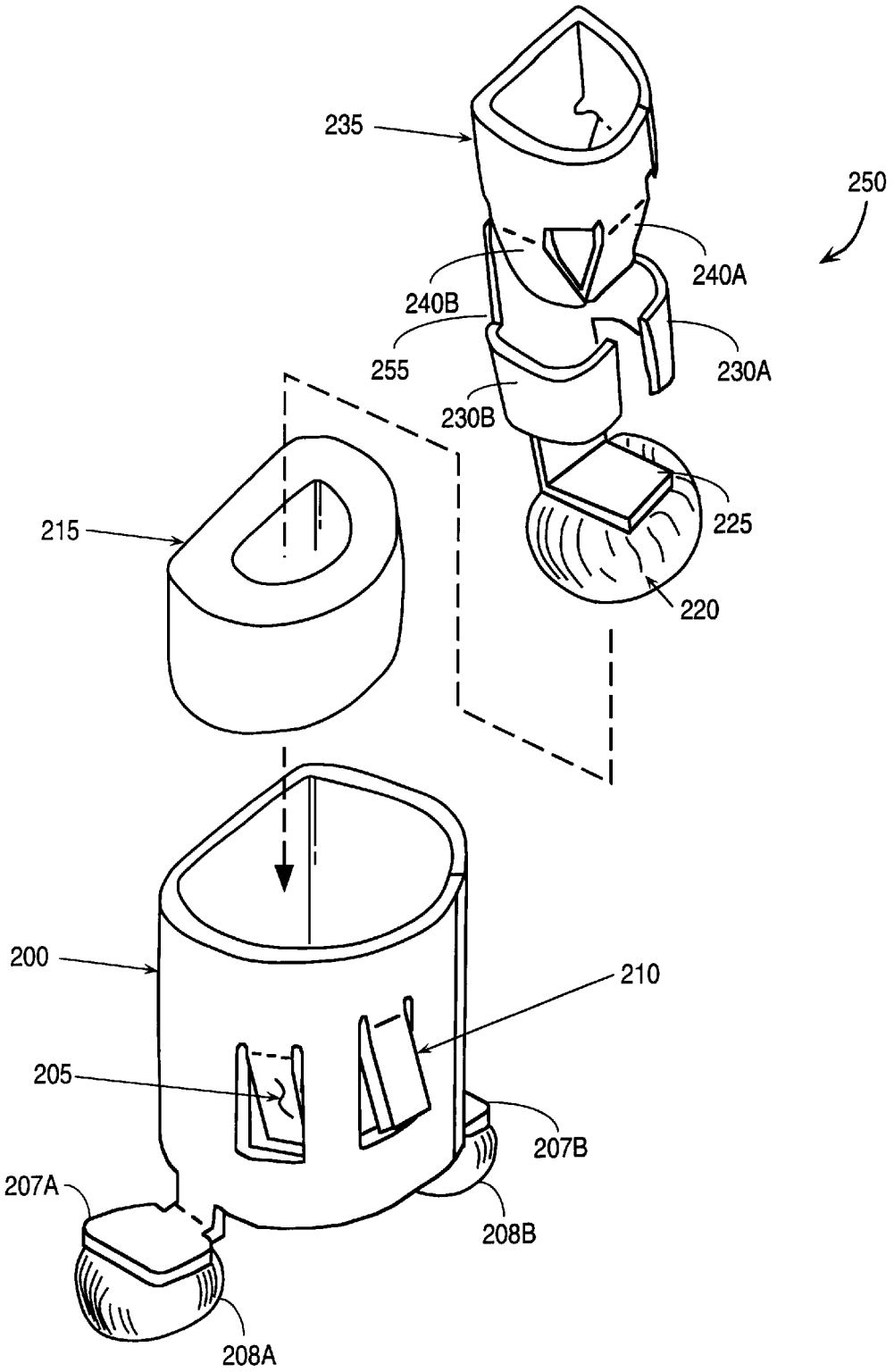
FIG. 2 illustrates an exploded isometric view of the socket portion of one embodiment of a coaxial connector.
Figure 3:
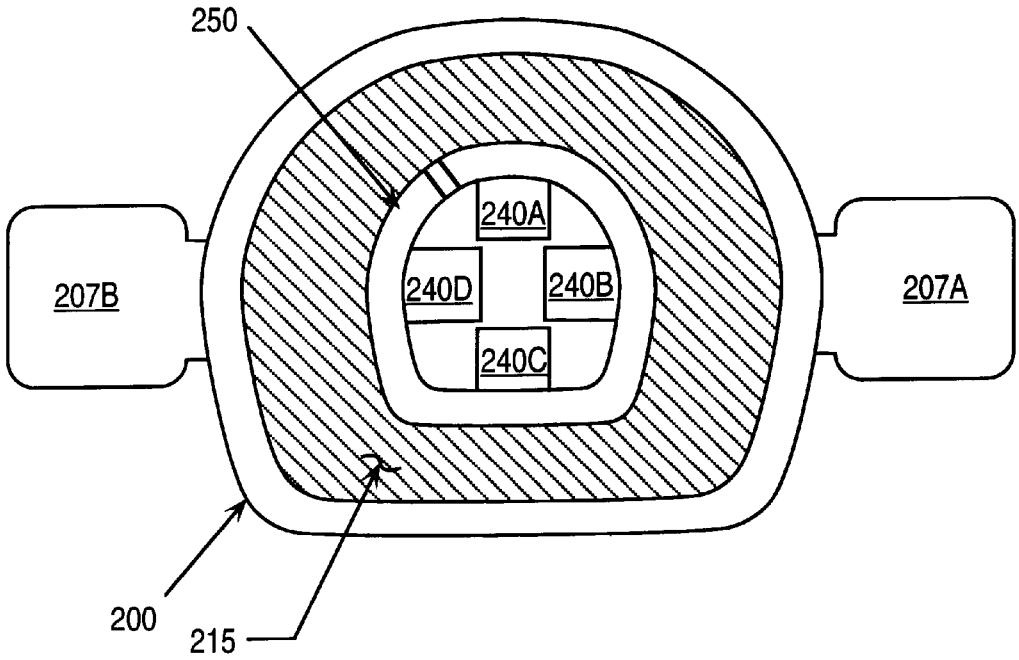
FIG. 3 illustrates a top view of the socket portion of the coaxial connector shown in FIG. 2.

An exploded isometric view and a top (plan) view of one embodiment of a barrier 200 and a socket portion 250 are shown in FIGS. 2 and 3. As shown by FIGS. 2 and 3, the socket portion is axially aligned (the axis being a vertical axis through approximately the center of the semi-cylindrical barrier 200) with the barrier 200, and an insulating material 215 may be interposed between the socket potion 250 and the barrier 200. By adjusting the distance between the barrier 200 and socket portion 250 (and therefore the pin when engaged) and/or varying the dielectric material used as the insulating material 215, a target impedance may be achieved. Accordingly, this connector may readily be tailored to a variety of high speed signaling environments.

As illustrated in FIG. 2, the barrier 200 includes at least one retaining tab 205 which holds the socket portion 250 in place during assembly and holds the insulating material 215 in place thereafter. The barrier 200 also includes a first retaining tab 210 and a second retaining tab (not shown) for retaining the barrier 200 in the connector housing. In this embodiment, two contacts 207*a* and 207*b* are provided (with optional solder balls 208*a* and 208*b*) for electrical connection to a circuit board.

The socket portion 250 includes a socket body 235 which is attached to a first end of a socket support member 255. The socket body 235 has an open top end and an open bottom end with inwardly bent rectangular tabs 240*a*, 240*b*, 240*c*, and 240*d* (the latter two being shown only in FIG. 3) attached thereto. The tabs 240*a*–240*d* contact a pin (as may also the socket body 235) when the pin portion of the connector is mated with the socket portion 250.

The socket support member 255 extends downwardly from the socket body 235 and has an electrical contact 225 attached at a second end. As illustrated, an optional solder ball 220 may also be included. At a point between the contact 225 and the socket body 235, the socket support member 255 has attached thereto two retaining tabs 230*a* and 230*b* which help secure the socket 250 inside the barrier 200 prior to soldering the connector to a circuit board. The tabs also hold the insulating material 215 in place after the connector is soldered to the circuit board.

Figure 4:
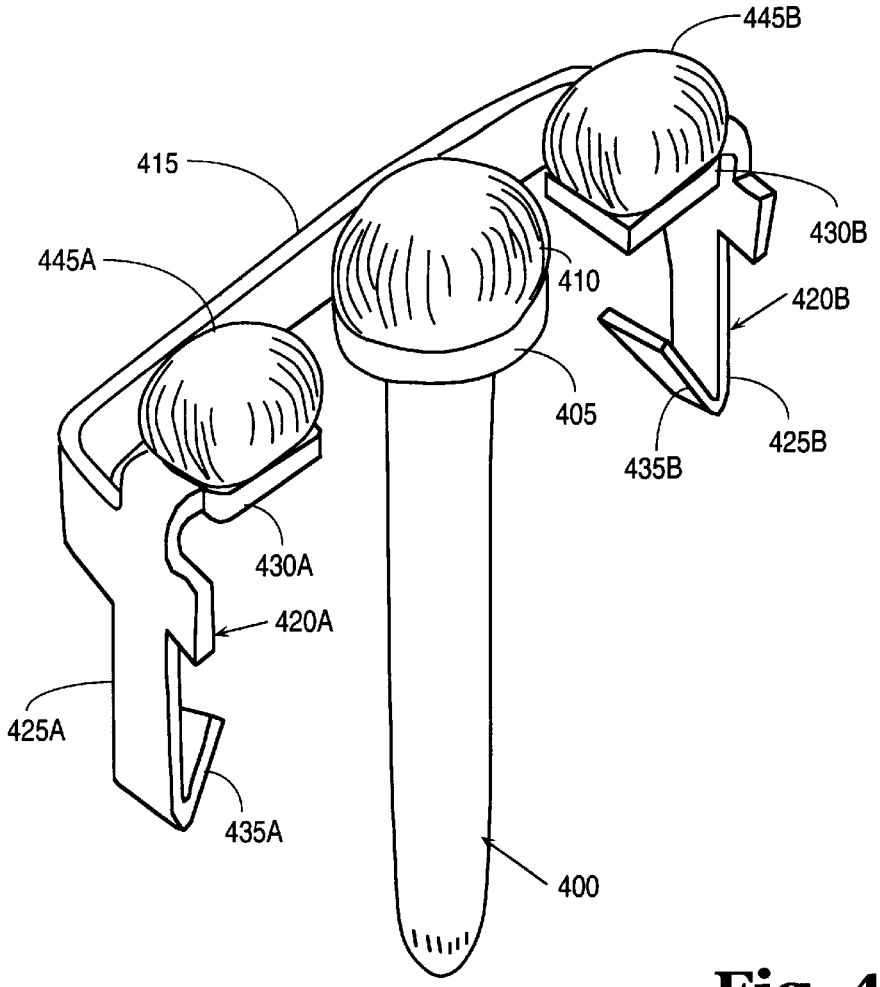
FIG. 4 illustrates an isometric view of the pin portion of one embodiment of a coaxial connector.
Figure 5:
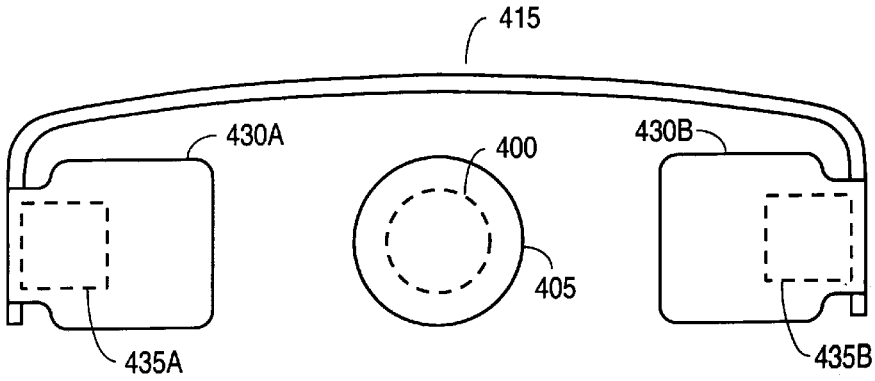
FIG. 5 illustrates a top view of the pin portion of the coaxial connector shown in FIG. 4.

FIGS. 4 and 5 illustrate isometric and top (plan) views of a pin portion and spring clips for electrically contacting the barrier 200 by engaging the exterior surface of the barrier 200. A contact 405 (having an optional solder ball 410 attached thereto) and an elongated pin portion 400 form the pin which is engaged by and contacts the socket portion 250. In this embodiment, the elongated pin portion 400 is cylindrical and the socket body 235 has a conforming approximately cylindrical shape. In other embodiments, other shapes may be used.

A spring clip support member 415 supports two spring clips 420*a* and 420*b*. Each spring clip has an optional solder ball (445*a* and 445*b*) attached to a contact portion (430*a* and

430*b*). A straight portion (425*a* and 425*b*) of each spring clip has a first end attached to the contact portion. The straight portion extends downwardly from the respective contact portion. An inwardly bent portion (435*a* and 435*b*) extends upwardly from a second end of each straight portion. Each inwardly bent portion makes electrical contact with the outer surface of the barrier 200 when the connector is mated.

Figure 6:
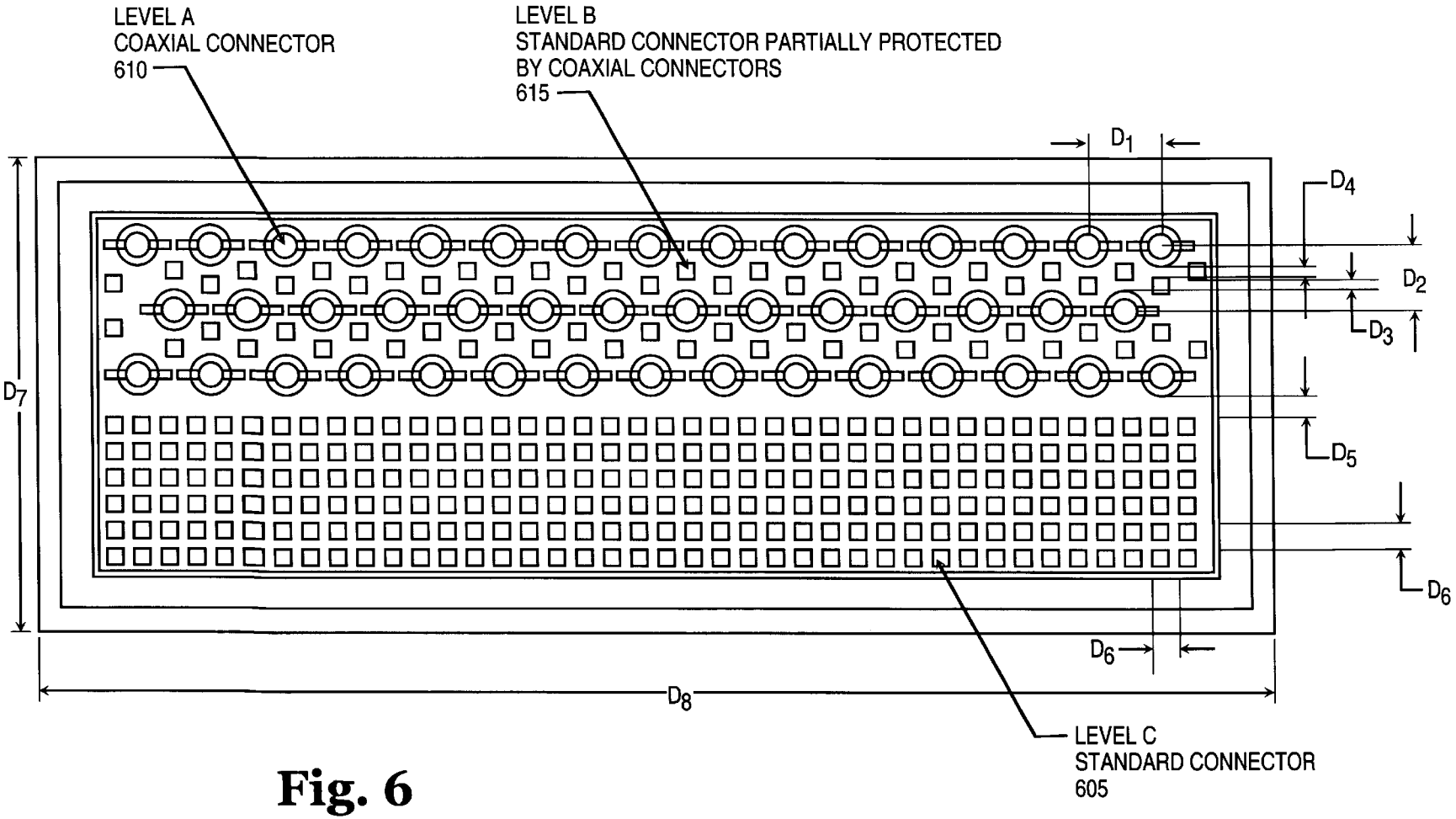
FIG. 6 illustrates one embodiment of a connector utilizing both standard and coaxial connectors to achieve three levels of impedance control.
Figure 7:
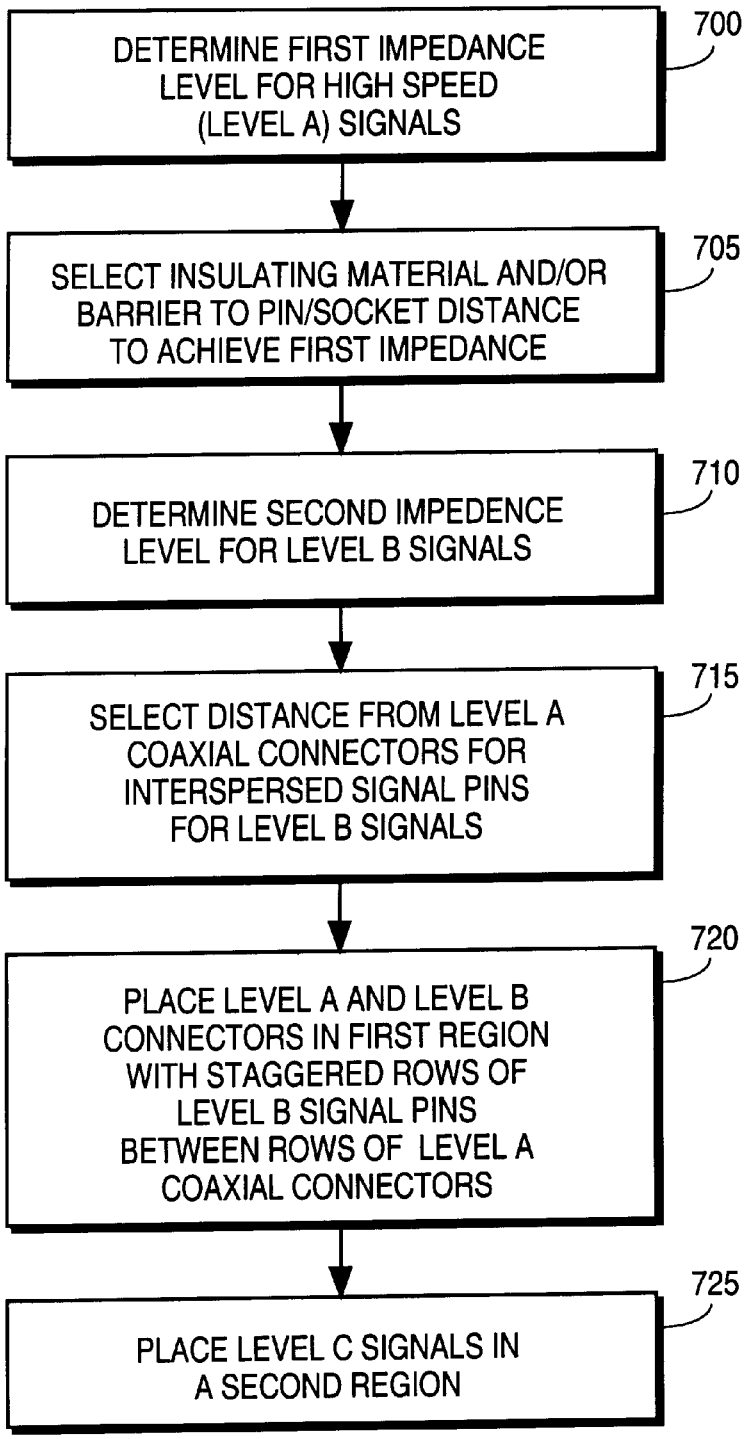
FIG. 7 illustrates one embodiment of a method of utilizing coaxial connectors.

FIG. 6 illustrates one embodiment of a connector arrangement where coaxial connectors are used in conjunction with standard pin/socket connectors to achieve three levels of impedance control. FIG. 7 illustrates a method for selecting an arrangement of and arranging such connectors. This type of connector arrangement may advantageously be employed where there are three different speeds, noise sensitivity levels, or other considerations which warrant signals being routed through such different connectors.

As indicated in step 700 of FIG. 7, a determination of the target impedance for the Level A signals should first be made. The Level A signals constitute those signals which require the most impedance control and/or noise immunity. The details of the connector (e.g., the insulating material and/or a specific barrier to pin/socket distance) may be chosen to achieve this first target impedance as shown in step 705.

Next, a second impedance level for Level B signals is determined as shown in step 710. Generally, Level B connectors will provide less noise immunity and impedance control than Level A connectors because Level B connectors do not have barriers coaxially about them, but rather have the barriers from the Level A connectors nearby. Thus, the distance and/or the arrangement of the interspersed Level B connectors is selected to achieve the second target impedance as illustrated in step 715.

Next, as indicated by step 720 and as illustrated in FIG. 6, the Level A connectors (e.g., coaxial connector 610) and Level B connectors (e.g., standard connector 615) are placed in a first region. In one embodiment, rows of Level B connectors are staggered between rows of Level A coaxial connectors. In the illustrated embodiment, the coaxial connectors are aligned in rows (i.e., as viewed in FIG. 6, the horizontal rows). The standard connectors form staggered rows between rows of coaxial connectors. In a single row of standard connectors between first and second rows of coaxial connectors, the standard connectors alternate between being aligned (along a line perpendicular to the row of coaxial connectors through the center of the coaxial connector) with the first and second row of coaxial connectors. A third row of coaxial connectors has each coaxial connector aligned with another in the first row, and standard connectors are staggered between the second and third row of coaxial connectors similarly to those between the first and second rows.

In other embodiments, the standard connectors may be interspersed between the coaxial connectors in other manners which alter distances from standard connectors to coaxial connectors, or which alter the number of one type of connector in proximity to the other. The final configuration may be chosen as needed to achieve a target impedance level sought for the level B signals.

As illustrated in step 725, the remaining standard connectors (e.g., standard connector 605) are disposed in a second region in a traditional grid pattern. These connectors provide a third level of impedance control (Level C) which is lower than Levels A and B. The least sensitive to noise or lowest frequency signals typically pass through the Level C connectors.

In one embodiment, the distances in the following table may be used as those correspondingly labeled in FIG. 6.

| Label | Description | Exemplary Distance (mm) |
|---|---|---|
| D1 | Distance between vertical rows of coaxial connectors | 3.302 |
| D2 | Distance between horizontal rows of coaxial connectors | 2.794 |
| D3, D4 | Clearance Between Coaxial Barrier and Standard Connector | .381 |
| D5 | Distance between last row of coaxial connectors and first row of standard connectors in grid pattern | .635 |
| D6 | Horizontal and vertical spacing of standard connectors in grid pattern | 1.27 |
| D7 | Horizontal length of connector arrangement | 55.625 +/− .635 |
| D8 | Vertical length of connector arrangement | 20.066 +/− .635 |

Thus, an improved method and apparatus for transferring signals through a high density, low profile, array type stacking connector is disclosed. While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art upon studying this disclosure.

What is claimed is:

1. An apparatus comprising:

a first engaging contact member, comprising a pin, mounted on a first circuit board and electrically coupled to a first signal line of the first circuit board;

a second engaging contact member, comprising a socket, for removably engaging said first engaging contact member, said second engaging contact member being mounted on a second circuit board and electrically connected to a second signal line of the second circuit board, said socket having a socket cylindrical portion that is supported by a socket support member and has an open top end and an open bottom end;

a conductive barrier member partially surrounding the second engaging contact member, said barrier member having at least one connector coupling said barrier member to at least one bias voltage line;

an insulating material disposed between the barrier member and said second engaging contact member, and wherein said barrier member further comprises a plurality of retaining tabs extending inwardly.

2. The apparatus of claim 1 wherein said at least one connector connecting said barrier member to a bias voltage line comprises:

a first connector and a second connector for connecting said barrier member to a first bias line in the first circuit board; and a third connector for connecting said barrier member to a second bias line in the second circuit board.

3. The apparatus of claim 1 wherein said socket comprises a plurality of retaining tabs attached to said socket support member.

4. The apparatus of claim 3 wherein said barrier member is positioned at a predetermined distance from said socket and said insulating material has a dielectric constant, the predetermined distance and said dielectric constant being chosen to achieve a target impedance.

5. The apparatus of claim 3 wherein said first circuit board and said second circuit board are substantially parallel and wherein the pin is substantially perpendicular to said first circuit board, and the socket portion and the barrier member are substantially perpendicular to the second circuit board.

6. The apparatus of claim 5 wherein said pin is an elongated cylindrical pin, said socket body is at least partially cylindrical, said barrier member is an approximately cylindrical metallic barrier member which is axially aligned with said socket portion and said elongated cylindrical pin when said socket portion engages said pin.

7. The apparatus of claim 5 further comprising:

a first spring clip attached to said first circuit board and positioned to contact said barrier member when said socket portion engages said pin;

a second spring clip attached to said first circuit board and positioned to contact said barrier member when said socket portion engages said pin;

a support member affixed to the first spring clip and the second spring clip, the support member supporting said first spring clip and said second spring clip in positions along a line perpendicular to a central axis formed by said pin.

8. The apparatus of claim 7 wherein said barrier member has a first spring contact notch and a second spring contact notch for engaging said first spring clip and said second spring clip.

9. The apparatus of claim 6 wherein said barrier member has a radius chosen to provide a target impedance.

10. The apparatus of claim 7 wherein each spring clip comprises:

a clip contact portion;

a straight portion extending downwardly from said clip contact portion; and an inwardly bent portion extending upwardly from a lower end of said straight portion to electrically contact said barrier member.

11. An apparatus comprising:

a first engaging contact member, comprising a pin, mounted on a first circuit board and electrically coupled to a first signal line of the first circuit board;

a second engaging contact member, comprising a socket, for removably engaging said first engaging contact member, said second engaging contact member being mounted on a second circuit board and electrically connected to a second signal line of the second circuit board, said socket having a socket cylindrical portion that is supported by a socket support member and has an open top end and an open bottom end, wherein said socket comprises a plurality of retaining tabs attached to said socket support member;

a conductive barrier member partially surrounding the first engaging contact member, said barrier member having at least one connector coupling said barrier member to at least one bias voltage line.

12. A connector comprising:

a socket portion comprising:

a socket cylindrical portion that is at least partially cylindrical to engage a pin portion when the pin portion and the socket portion are mated, said socket cylindrical portion having an open top end and an open bottom end;

an elongated socket support member extending downwardly from said socket cylindrical portion to a socket contact;

a barrier member axially aligned with and at least partially surrounding the socket portion, said barrier member also having at least one electrical connector for connecting to at least one bias line at one of a top end and a bottom end; and an insulating material disposed between the barrier member and the socket portion;

a support member having affixed thereto a first spring clip and a second spring clip, the support member supporting said first spring clip and said second spring clip in positions along a line perpendicular to a central axis formed by said elongated pin portion; and a first spring clip contact and a second spring clip contact on said barrier member for engaging said first spring clip and said second spring clip when said pin and said socket portion are engaged.

13. The connector of claim 12 wherein said barrier member includes a plurality of inwardly extending retaining tabs.

14. The connector of claim 12 wherein said socket portion further comprises a plurality of retaining tabs.

15. The connector of claim 14 wherein said plurality of retaining tabs are attached to said socket support member.

16. An apparatus comprising:

a plurality of coaxial connectors, each coaxial connector having an inner pin substantially surrounded by an outer metallic barrier, said plurality of coaxial connectors providing a first plurality of connections having a first impedance;

a plurality of signal pin connectors interspersed between said plurality of coaxial connectors to provide a second plurality of connections having a second impedance that is different than the first impedance, wherein the plurality of coaxial connectors form a first row and a second row in a first direction, said second row having coaxial connectors offset from those in the first row, and wherein the plurality of signal pin connectors are interspersed between the plurality of coaxial connectors form a row with alternating pin connectors being aligned with coaxial connectors in the first row and the second row of coaxial connectors and further wherein alternating pin connectors are offset in a second direction perpendicular to the first direction.

17. The apparatus of claim 16 wherein the plurality of coaxial connectors and the plurality of signal pin connectors are in a first connector region, the apparatus further comprising:

a second plurality of signal pin connectors in a second connector region, the second plurality of signal pin connectors forming a third plurality of connections having a third impedance that is different than the first impedance and the second impedance.

18. The apparatus of claim 16 wherein a first predetermined distance between the inner pin and the outer metallic barrier of each of the plurality of coaxial connectors is selected to determine the first impedance for the plurality of coaxial connectors.

19. The apparatus of claim 18 wherein a second predetermined distance between each of the plurality of signal pin connectors and one or more adjacent metallic barriers of the plurality of coaxial connectors is selected to determine the second impedance for the plurality of signal pin connectors.

20. The apparatus of claim 16 wherein the plurality of coaxial connectors also forms a third row which is aligned in the first direction and having individual connectors aligned with those in the first row, and further wherein the plurality of signal pin connectors are also interspersed between the second row and the third row of coaxial connectors with alternating pin connectors between the second row and the third row of coaxial connectors also being offset in the second direction.

21. The apparatus of claim 16 wherein successive coaxial connectors are placed approximately 3.3 millimeters apart, and the first row and the second row of coaxial connectors are placed approximately 2.79 millimeters apart.

22. A method comprising:

mounting a plurality of coaxial connectors in a first region to form a first plurality of connectors having a first impedance; and mounting a plurality of pin connectors in a said first region interspersed between the plurality of coaxial connectors to form a second plurality of connectors having a second impedance that is different than the first impedance, wherein the plurality of coaxial connectors form a first row and a second row in a first direction, said second row having coaxial connectors offset from those in the first row, and wherein the plurality of pin connectors are interspersed between the plurality of coaxial connectors form a row with alternating pin connectors being aligned with coaxial connectors in the first row and the second row of coaxial connectors, and further wherein alternating pin connectors are offset in a second direction perpendicular to the first direction.

23. The method of claim 22 further comprising:

mounting a second plurality of pin connectors in a second region to form a third plurality of connectors having a third impedance that is different than said first impedance and said second impedance.

24. The method of claim 22 wherein said plurality of pin connectors are differently shaped than said plurality of coaxial connectors.

25. The apparatus of claim 16 wherein said plurality of signal pin connectors are differently shaped than said plurality of coaxial connectors.

26. The apparatus of claim 1 wherein said socket has a plurality of inwardly bent tabs attached to said open bottom end, and wherein said socket support member has affixed thereto a plurality of retaining tabs, and further wherein said barrier member has a plurality of retaining tabs extending inwardly to retain said insulating material inside said insulating material during assembly and to secure said insulating material.

27. An apparatus comprising:

a first row of coaxial connectors aligned in a first direction;

a second row of coaxial connectors also aligned in the first direction, the second row having connectors offset from those in the first row;

a row of pin connectors interspersed between the first and second rows of coaxial connectors, the row of signal pin connectors having alternating pin connectors that are aligned with coaxial connectors in the first row and the second row and that are offset in a second direction perpendicular to the first direction.

* * * * *

UNITED STATES PATENT AND TRADEMARK OFFICE

CERTIFICATE OF CORRECTION

PATENT NO. : 6,183,266 B1
DATED : February 6, 2001
INVENTOR(S) : Turner

It is certified that error appears in the above-identified patent and that said Letters Patent is hereby corrected as shown below:

Title page,
Item [73], Assignee, delete "Intle" and insert -- Intel --.

Signed and Sealed this

Twenty-fifth Day of June, 2002

*Attest:*

*Attesting Officer*

JAMES E. ROGAN
*Director of the United States Patent and Trademark Office*